US009655483B2

(12) United States Patent
Forrest et al.

(10) Patent No.: US 9,655,483 B2
(45) Date of Patent: May 23, 2017

(54) GRAB BAR WITH INSERT

(75) Inventors: Earl David Forrest, Asheboro, NC (US); Andrew James Graff, Greensboro, NC (US); Jeffrey Allen DeBoer, Ann Arbor, MI (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 2913 days.

(21) Appl. No.: 12/034,934

(22) Filed: Feb. 21, 2008

(65) Prior Publication Data

US 2009/0211014 A1 Aug. 27, 2009

(51) Int. Cl.
*A47K 3/024* (2006.01)
*A47K 17/02* (2006.01)

(52) U.S. Cl.
CPC ..... *A47K 17/022* (2013.01)

(58) Field of Classification Search
USPC ..... 4/498, 576.1, 599, 610, 596, 692, 684; 40/124.05; 16/436, 426, 412, 402; 297/183.1
See application file for complete search history.

(56) References Cited

U.S. PATENT DOCUMENTS

| | | | | |
|---|---|---|---|---|
| 2,962,827 | A * | 12/1960 | Lachance et al. | 40/308 |
| 3,393,423 | A * | 7/1968 | Adams | 16/444 |
| 5,487,203 | A * | 1/1996 | Brach et al. | 15/245 |
| 5,743,064 | A * | 4/1998 | Bennett | 52/718.04 |
| 5,810,372 | A * | 9/1998 | Arendt | 280/33.992 |
| 5,862,847 | A * | 1/1999 | Jenkins | 144/346 |
| 6,212,809 | B1 * | 4/2001 | Gaule | 40/660 |
| 6,817,044 | B1 * | 11/2004 | Ouyoung | 4/576.1 |
| 7,143,535 | B1 * | 12/2006 | Cobb et al. | 40/611.08 |
| 2004/0078933 | A1 * | 4/2004 | Forrest | 16/417 |
| 2006/0012189 | A1 * | 1/2006 | Olivier et al. | 292/336.3 |
| 2008/0078904 | A1 * | 4/2008 | Trimble | 248/251 |

* cited by examiner

*Primary Examiner* — Lauren Crane
(74) *Attorney, Agent, or Firm* — Carlson, Gaskey & Olds, PC

(57) ABSTRACT

A grab bar includes a front facing side and a wall facing side that is opposite from the front facing side. The grab bar is attached to a wall structure with at least one mounting assembly at the wall facing side. A removable decorative insert is supported by the front facing side. The removable decorative insert is easily removed and replaced by other decorative inserts as needed without having to remove the grab bar from the wall structure.

29 Claims, 4 Drawing Sheets

GRAB BAR WITH INSERT

TECHNICAL FIELD

This invention relates to a bar that is utilized in bathrooms, such as a grab bar for example, where the bar includes a removable decorative insert.

BACKGROUND OF THE INVENTION

Grab bars are utilized in bathroom applications to provide support for an individual during exit or entry in a bathtub or shower, for example. Typical grab bars include a linear/straight body member that is spaced apart from, and parallel to, a wall. The grab bar has end mounts that extend toward the wall such that the grab bar can be mounted to the wall. In some configurations, the linear/straight body member may include angled portions such that the grab bar can be gripped at different orientations.

For use in hotels, homes, and other non-institutional-type environments, it is often desirable to have a grab bar that presents an aesthetically appealing appearance. Due to the time and labor involved with installing grab bars, changing or replacing a grab bar to reflect a change in room décor can be expensive.

Thus, there is a need to provide a grab bar that can be easily adapted to various decors without having to completely replace an entire grab bar assembly.

SUMMARY OF THE INVENTION

A grab bar for use in a bathroom structure such as a shower or tub, for example, includes a front facing side and a wall facing side that is opposite from the front facing side. A removable decorative insert is supported by the front facing side. The removable decorative insert is easily removed and replaced by other decorative inserts as needed.

In one example, the body member is comprised of an extruded component with a generally uniform wall thickness.

In one example, the body member includes a recess formed within the front facing side that extends from a first end to a second end of the body member. The removable decorative insert is received within the recess.

At least one mounting assembly is used to attach the wall facing side of the grab bar to a wall structure. The removable decorative insert can be removed and replaced with other decorative inserts without having to detach the grab bar and mounting assembly from the wall structure.

In one example, an opening is formed within the wall facing side of the body member. The opening receives a fastener that, when rotated, contacts a rear facing side of the removable decorative insert to push the removable decorative insert out of the recess such that the removable decorative insert can be replaced with another insert.

In one example, the recess includes at least one groove that extends along an edge of the recess. A resilient member, such as a resilient tube for example, is resiliently retained within the groove. The resilient member is movable between an initial shape when the removable decorative is removed from the recess and a compressed shape when the removable decorative insert is installed within the recess. When installed, the resilient member holds the removable decorative insert securely in place.

The subject grab bar includes an insert that provides an aesthetically pleasing appearance for the grab bar as well as being easily interchangeable with other inserts to change the appearance of the grab bar. These and other features of the present invention can be best understood from the following specification and drawings, the following of which is a brief description.

DETAILED DESCRIPTION OF THE PREFERRED EMBODIMENT

Figure 1:
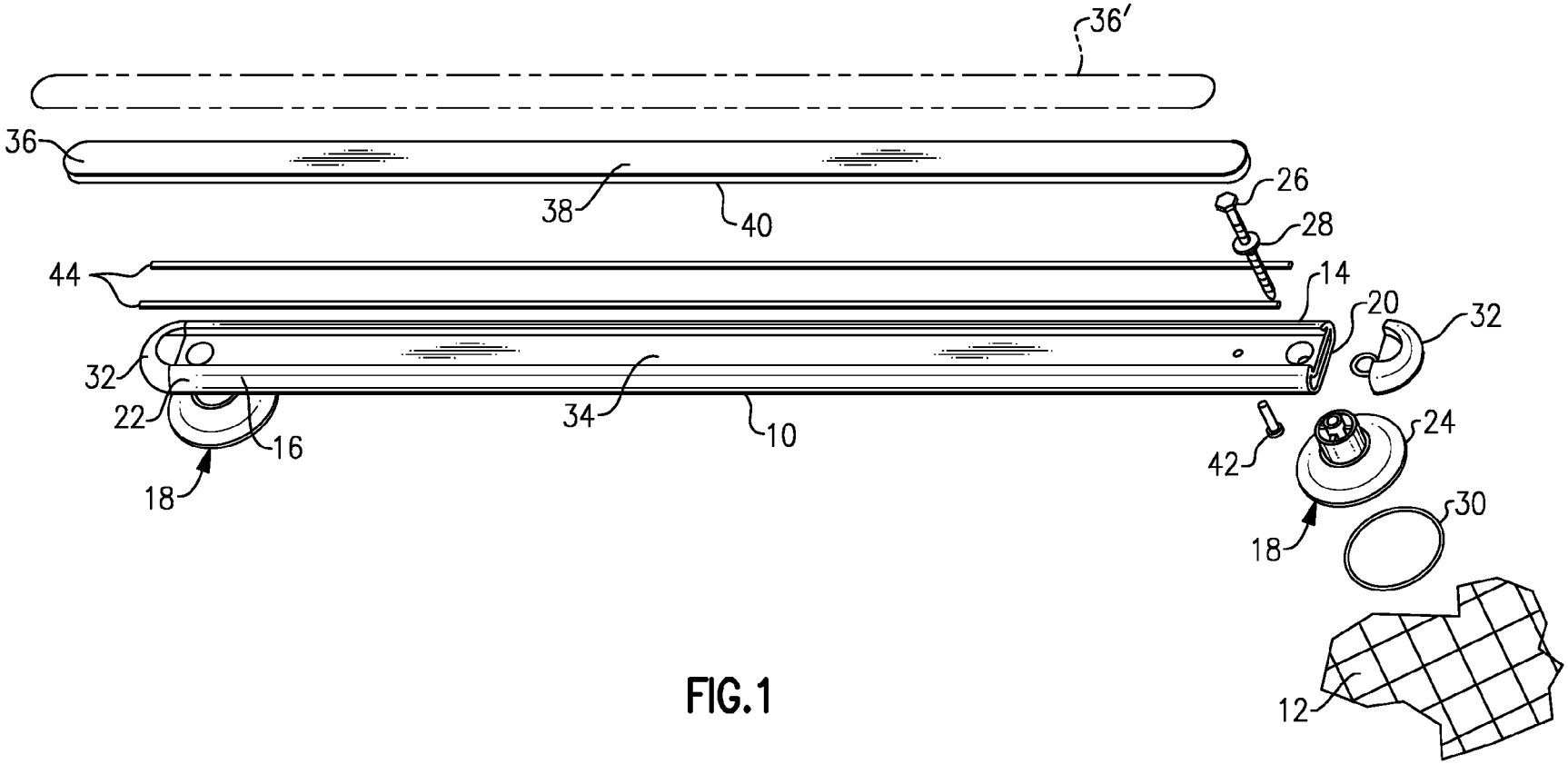
FIG. 1 is a perspective view of a grab bar assembly with a removable decorative insert.

A grab bar 10 for attachment to a bathroom wall structure 12 is shown in FIG. 1. The grab bar 10 extends between first 14 and second 16 ends. Mounting assemblies 18 are positioned near each of the first 14 and second 16 ends such that the grab bar 10 can be secured to the bathroom wall structure 12. In the example shown in FIG. 1, the grab bar 10 is a generally straight configuration; however, the grab bar 10 could include one or more angled portions or could have a non-linear configuration, such as an oval, triangular, or round shape for example. Further, while two mounting assemblies 18 are shown, it should be understood that a single mounting assembly could be used, or additional mounting assemblies could be used, depending upon the overall configuration of the grab bar.

The grab bar 10 is formed from a hollow body structure or member that includes a wall facing side 20 and a front facing side 22 that is opposite the wall facing side 20. In one example, the body structure comprises an extruded component made from aluminum or other material, and which includes a generally uniform wall thickness from the first end 14 to the second end 16. Each mounting assembly 18 is attached to the wall facing side 20 near the first 14 and second 16 ends as shown.

Each mounting assembly 18 includes at least a base flange and post assembly 24, a mounting fastener 26 and washer 28, and an o-ring 30. The mounting fastener 26 is inserted through the grab bar 10, through the base flange and post assembly 24, and into the wall mount structure 12 to secure the grab bar 10 to the wall mount structure 12. End caps 32 are secured to the first 14 and second 16 ends of the grab bar 10.

The front facing side 22 of the grab bar 10 includes a recess 34 that extends from the first end 14 to the second end 16. In one example, the recess 34 extends along an entire length of the grab bar 10 from an end face of the first end 14 to an end face of the second end 16. A decorative insert 36 is received within the recess 34. The decorative insert 36 includes a front face 38 and a rear face 40. The front face 38 includes a decorative surface that provides an aesthetically appealing appearance for the grab bar 10.

A fastener 42 is located near the first end 14 of the grab bar 10 and is used to remove the decorative insert 36 from the recess 34 such that another decorative insert 36' can be installed within the recess 34. This will be discussed in greater detail below. The other decorative insert 36' can have the same or similar appearance to the first decorative insert 36, or can have a different appearance. As such, the grab bar 10 includes a removable decorative insert 36 that can be easily replaced with a different decorative insert 36' without having to detach and replace the entire grab bar assembly.

In one example, the decorative insert is made of recycled plastic, which is laminated on both sides with wood grain, faux stone, or faux marble using a "Formica" type material such as that which is used on kitchen counter tops. In this example, the design would generally have a flat surface; however, other design elements and materials could be used to form the decorative insert 36. For example, the decorative insert 36 could have a textured surface. Optionally, materials such as glow in the dark (GITD) polymers could be used alone or in combination with an aggregate material. Such a configuration would give guidance and provide a more clearly seen handhold in dark or low-light environments.

Figure 2:
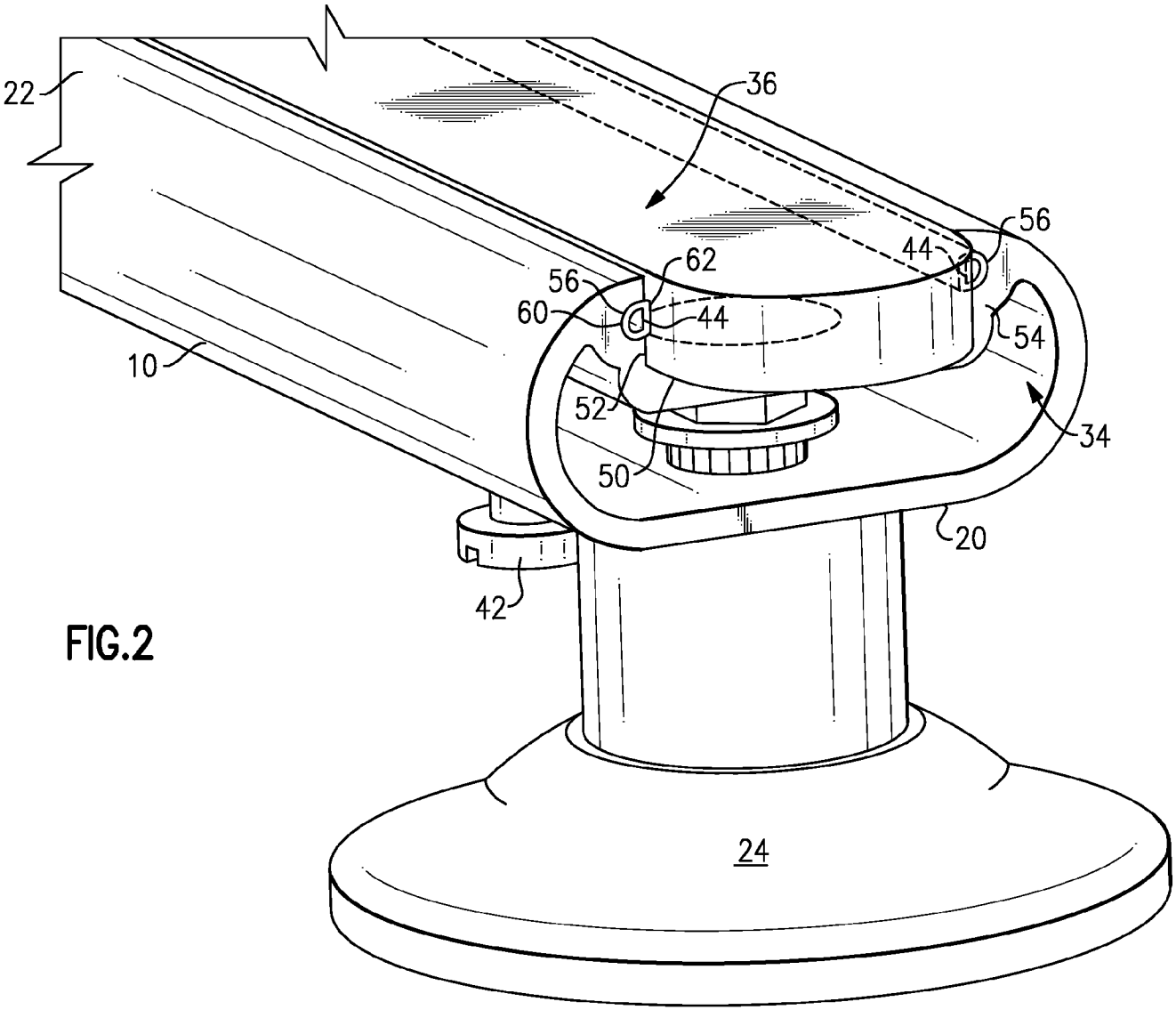
FIG. 2 is an enlarged end view of the grab bar assembly of FIG. 1 with an end cap removed for clarity.

The decorative insert 36 is resiliently retained within the recess 34 by at least one resilient member 44. This attachment interface is shown in greater detail in FIG. 2. The recess 34 in the grab bar 10 is defined by a bottom surface 50 and by first 52 and second 54 wall surfaces that extend outwardly from the bottom surface 50 toward the front facing side 22 of the grab bar 10. In each of the first 52 and second 54 wall surfaces, a groove 56 is formed. The grooves 56 extend along a length of the grab bar 10 and are generally parallel to the recess 34. In one example, the grooves 56 extend along an entire length of the first 52 and second wall surfaces; however, the grooves could also be configured to extend only along a specified portion of the wall surfaces. Further, while two grooves 56 are shown, it should be understood that only a single groove, or additional grooves, may be formed dependent upon the shape, size, etc. of the grab bar 10.

One resilient member 44 is received within each of the grooves 56. In one example, the resilient member 44 comprises a resilient tube; however, other types of resilient members could also be used. The resilient member 44 is movable between an initial position when the decorative insert 36 is not installed within the recess 34 and a compressed position when the decorative insert 36 is installed within the recess 34. The resilient member 44 is hollow and is defined by an outer peripheral or circumferential surface 60 and an inner peripheral or circumferential surface 62. When the resilient members 44 are installed within the grooves 56, prior to the decorative insert 36 being installed, over half of the outer peripheral surface 60 is in contact with a groove surface that defines the grooves 56. The groove surface is sized to be slightly less than the outer diameter of the resilient members 44. As such, the resilient members 44 are installed by being rolled into the grooves 56, and are held in place by spring tension between the resilient member 44 itself and the groove surface of the grooves 56. In other words, the resilient member 44 is slightly compressed when installed within the groove 56, and this compression force is sufficient to hold the resilient member 44 in place.

Once the resilient members 44 are installed, the decorative insert 36 can be inserted into the recess 34. Installing the decorative insert 36 compresses the generally round shape of the resilient members 44 into a generally D-shaped cross-section, i.e. the resilient members 44 are further compressed when the decorative insert 36 is installed. This additional compressive force, in conjunction with the frictional resistance between the resilient members 44 and the decorative insert 36, securely holds the decorative insert 36 in place. Thus, the decorative insert 36 is solely retained in place by the resilient members 44.

Figure 3:
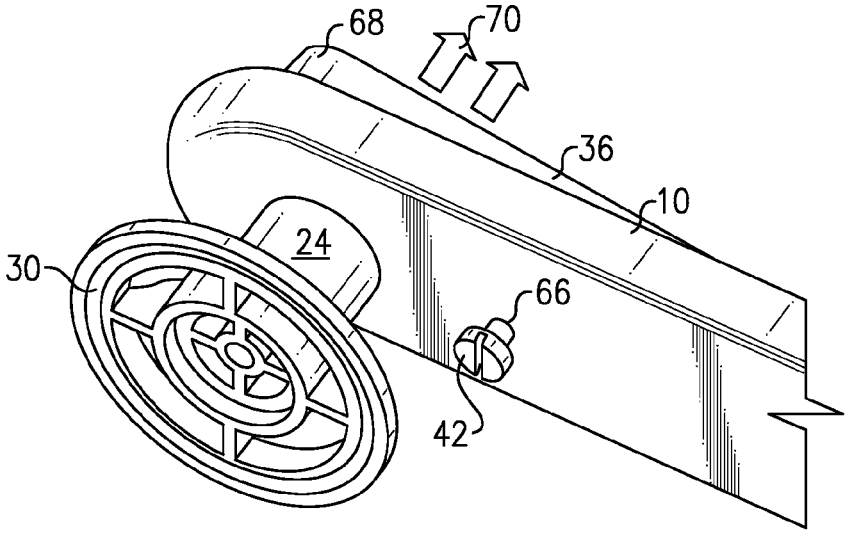
FIG. 3 is an enlarged wall facing view of the grab bar assembly of FIG. 1 showing a removal step for the removable decorative insert.

Removal of the decorative insert 36 is shown more clearly in FIG. 3. An opening 66 is formed within the wall facing side 20 of the grab bar 10 to receive the fastener 42. In one example, the grab bar 10 is drilled and tapped at the first end 14 to receive the fastener 42, which in the example comprises a nylon machine screw; however, other types of hole and fastener configurations could also be used. Further, the position of the opening 66 could be varied, or additional openings could be used, as needed. By turning the fastener 42, the fastener 42 makes contact with the rear side 40 of the decorative insert 36 to avoid marring a surface finish on the rear side 40. As the fastener 42 is further rotated, pressure is applied to the insert 36, forcing an end portion 68 of the decorative insert 36 to rise out of the recess 34 as indicated at 70. Once the decorative insert 36 is sufficiently out of the recess 34, the end portion 70 can be grabbed and pulled completely out of the recess 34 for replacement.

Figure 4:
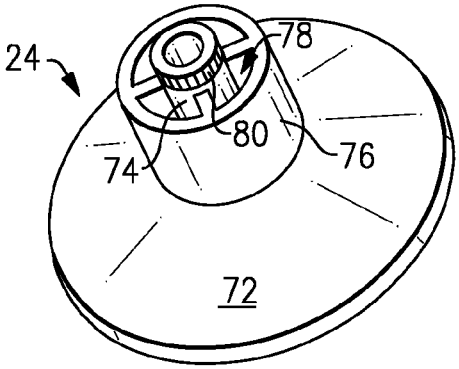
FIG. 4 is a perspective view of a base flange and post assembly.
Figure 5:
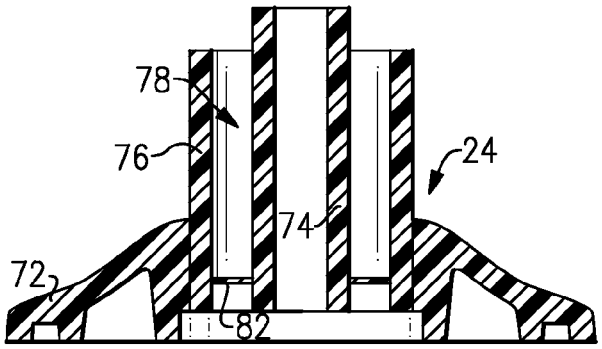
FIG. 5 is a cross-sectional view of the base flange and post assembly of FIG. 4.

The base flange and post assembly 24 that is used to secure the grab bar 10 to the wall mount structure 12 is shown in greater detail in FIGS. 4-5. The base flange and post assembly 24 includes a base portion 72 to be associated with a surface of the wall mount structure 12, a post portion 74 that extends outwardly from the base portion 72 toward the wall facing side 20 of the grab bar 10, and a sleeve portion 76 that surrounds the post portion 74, and which is spaced apart from the post portion by an air gap 78. In one example, the base flange and post assembly 24 comprises a single-piece component. This generally hollow configuration of the base flange and post assembly 24 provides a material cost savings.

An end surface 80 of the post portion 74 is comprised of a knurled surface that interfaces with the grab bar body and the end cap 32. This knurled end surface 80 serves as a press-fit location between the grab bar 10 and the end cap 32. Additionally, the base flange and post assembly 24 includes a thin-walled section 82 that extends across the air gap 78 from an inner surface of the sleeve portion 76 to an outer surface of the post portion 74. The thin-walled section 82 is generally perpendicular to the post portion 74. This thin-walled section 82 prevents water infiltration from the front of the grab bar 10 to the wall. The remaining points of entry for water are sealed off by the washer 28 and o-ring 30.

Figure 6:
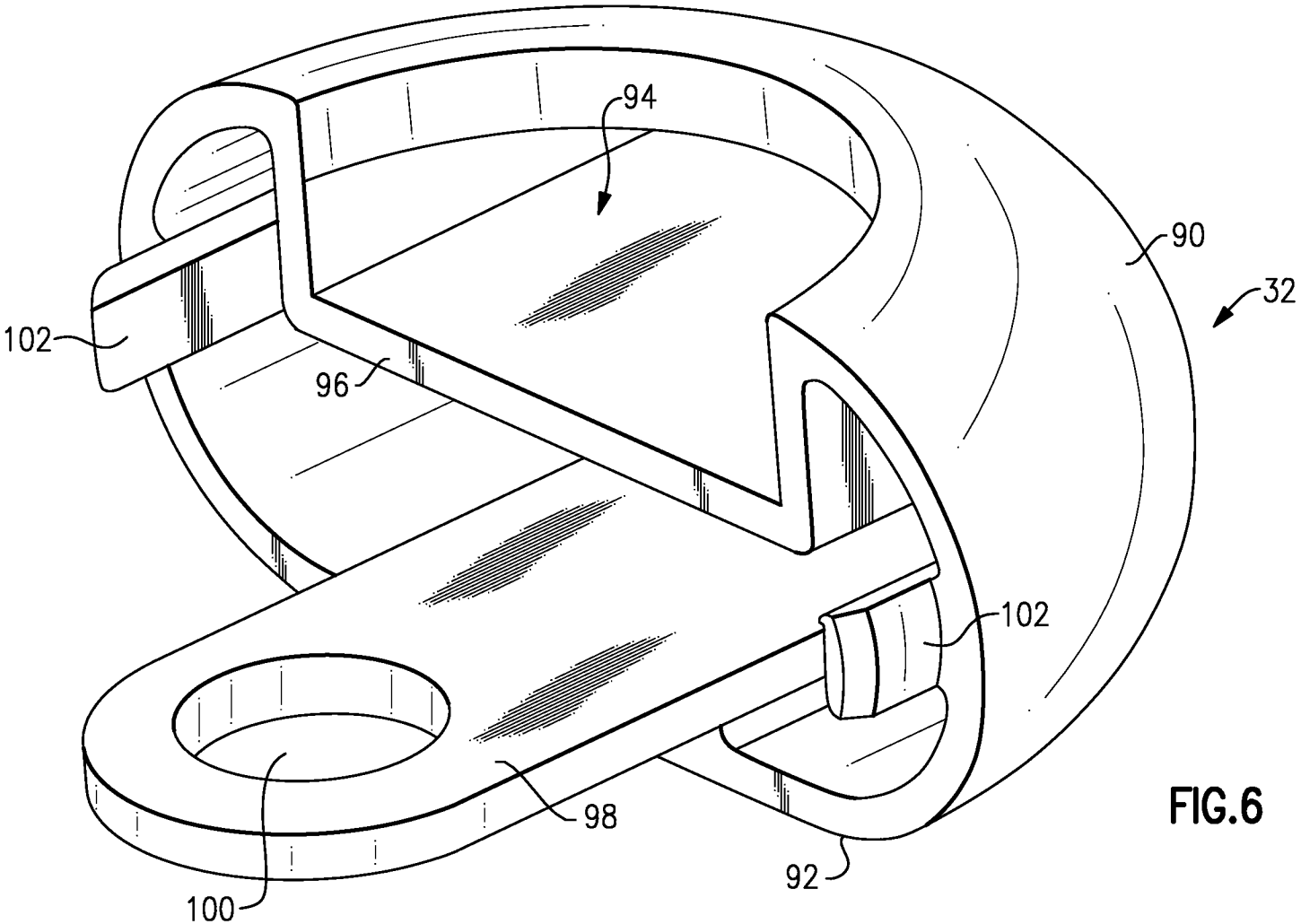
FIG. 6 is a perspective view of an end cap.

The end cap 32 is shown in greater detail in FIG. 6. One end cap 32 is installed within the first end 14, and another end cap 32 is installed within the second end 16. Each end cap 32 includes a front side 90 and a rear side 92. An end cap recess 94 is formed with the front side 90, which aligns with the recess 34 in the grab bar 10. The end cap recesses 94 receive end portions of the decorative insert 36.

The end cap 32 includes an abutment surface 96 that abuts against an end face of a respective one of the first 14 and second 16 ends. The end caps 32 also include an extension tab 98 that extends inwardly toward the grab bar 10 beyond the abutment surface 96. The extension tab 98 includes a through hole 100 that cooperates with the knurled end surface 80 of the post portion 74 to securely hold the end cap 32 in place. An axis of the through hole 100 is positioned such that it is aligned with an axis of the base flange diameter at the same time the abutment surface 96 makes contact with the end faces of the grab bar 10. To ensure that the end cap 32 is in proper alignment with these end faces, alignment tabs 102 are formed within the end cap 32. Each alignment tab 102 engages an inner surface of the hollow body member that defines the grab bar 10. It should be understood that FIG. 6 shows one example of an end cap, and that other end cap configurations could also be used.

As described in detail above, the grab bar 10 is designed to hold replaceable decorative inserts 36 in a recess 34 formed within the grab bar 10. The insert can be formed from many different materials, and can have smooth, textured, or other surface configurations to provide a desired aesthetic appearance. The insert can be easily removed and replaced with other inserts as needed without having to detach and replace the entire grab bar assembly. The base flange and post assembly 24 is ideally configured with a hollow structure to provide a more cost effective design solution without affecting the strength of the attachment joint. Further, the base flange and post assembly 24 are press fit into the grab bar 10 and end cap 32 to hold these components together during shipment. The stack-up of the base flange and post assembly 24, the body of grab bar 10, and end caps 32 are such that all components are in compression once the mounting fasteners are in place.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A bathroom grab bar comprising:

a body member having a front facing side and a wall facing side opposite from said front facing side;

a mount configured to attach said body member to a bathroom wall structure; and a removable decorative insert supported by said front facing side, said removable decorative insert having a front face that forms a decorative outer surface of the bathroom grab bar that extends uninterrupted from a first end of the removable decorative insert to a second end of the removable decorative insert.

2. The bathroom grab bar according to claim 1 wherein said body member has a first end and a second end, and wherein said front facing side includes a recess formed within said body member that extends between said first and second ends, said removable decorative insert being installed within said recess.

3. The bathroom grab bar according to claim 2 wherein said recess extends along an entire length of said body member from said first end to said second end.

4. The bathroom grab bar according to claim 2 wherein said recess is defined by a bottom surface with first and second wall portions extending outwardly from said bottom surface toward said front facing side, and including at least one groove formed within at least one of said first and second wall portions to extend along at least a portion of a length of said body member, said at least one groove receiving a resilient member to securely hold said removable decorative insert within said recess.

5. A bathroom grab bar comprising:

a body member having a front facing side and a wall facing side opposite from said front facing side, wherein said body member has a first end and a second end, and wherein said front facing side includes a recess formed within said body member that extends between said first and second ends;

said recess being defined by a bottom surface with first and second wall portions extending outwardly from said bottom surface toward said front facing side;

at least one groove formed within at least one of said first and second wall portions to extend along at least a portion of a length of said body member, said at least one groove receiving a resilient member to securely hold said removable decorative insert within said recess; and a removable decorative insert supported by said front facing side and installed within said recess, said removable decorative insert having a front face that forms a decorative outer surface of the bathroom grab bar, and wherein said resilient member comprises a resilient tube being movable between an initial shape when said removable decorative insert is removed from said recess and a compressed shape when said removable decorative insert is installed within said recess.

6. The bathroom grab bar according to claim 5 wherein said resilient tube is defined by an outer peripheral surface and wherein more than half of the outer peripheral surface is in contact with a groove surface of said at least one groove when said resilient tube is inserted into said at least one groove.

7. The bathroom grab bar according to claim 4 including an opening formed within said wall facing side of said body member and a fastener installed within said opening, said fastener being movable to contact a rear side of said removable decorative insert to push said removable decorative insert out of said recess such that said removable decorative insert can be removed and replaced by another decorative insert.

8. A bathroom grab bar comprising:

a body member having a front facing side and a wall facing side opposite from said front facing side, and wherein said body member has a first end and a second end, and wherein said front facing side includes a recess formed within said body member that extends between said first and second ends; and a removable decorative insert supported by said front facing side and installed within said recess, said removable decorative insert having a front face that forms a decorative outer surface of the bathroom grab bar; and first and second end caps that are attached to said first and second ends, respectively, said first and second end caps each including an end cap recess that is aligned with said recess in said body member, and wherein said end cap recesses each receive an end portion of said removable decorative insert such that the front face of the decorative insert that forms the decorative outer surface of the bathroom grab bar also extends over an outwardly facing surface of the first and second end caps.

9. The bathroom grab bar according to claim 8 wherein each of said first and second end caps includes an abutment surface that abuts against an end face of a respective one of said first and second ends.

10. The bathroom grab bar according to claim 9 wherein each of said first and second end caps includes an extension tab that extends axially inward of said abutment surface, said extension tab including a through hole to receive a portion of a base flange and post assembly.

11. The bathroom grab bar according to claim 10 wherein said base flange and post assembly comprises a single piece component having a base portion to be associated with a wall mount surface and a post portion extending outwardly from said base portion, said post portion including a knurled surface that makes contact with a mount surface of said body member and a hole surface that defines said through hole in said extension tab.

12. The bathroom grab bar according to claim 11 wherein said base flange and post assembly includes an outer sleeve portion surrounding said post portion and spaced apart from said post portion by an air gap, and wherein a thin-wall portion extends across said air gap from an inner surface of said sleeve portion to an outer surface of said post portion to provide a fluid barrier.

13. The bathroom grab bar according to claim 1 wherein said body member comprises an extruded component having a generally uniform wall thickness.

14. A method of assembling a bathroom grab bar comprising the steps of:

(a) providing a body member having a front facing side and a wall facing side opposite of the front facing side;

(b) providing a mount configured to attach the body member to a bathroom wall structure; and (c) installing a removable decorative insert in the front facing side of the body member such that a front face of the removable decorative insert forms a decorative outer surface of the bathroom grab bar and such that an outwardly facing surface of the removable insert presents an outermost surface that extends uninterrupted from one end of the removable insert to an opposite end of the removable insert.

15. The method according to claim 14 wherein the removable decorative insert comprises a first insert having a first decorative surface and including (c) removing the first insert and installing a second insert in the front facing side of the body member where the second insert has a second decorative surface different than the first decorative surface.

16. The method according to claim 14 wherein step (a) includes forming a recess in the front facing side that extends from a first end of the body member to a second end of the body member, and wherein step (b) includes installing the removable decorative insert within the recess.

17. The method according to claim 16 including resiliently retaining the removable decorative insert within the recess.

18. The method according to claim 14 wherein the body member is configured to be fixed to a bathroom wall structure, and including (c) resiliently retaining the removable decorative insert within the body member via a resilient retaining force, and replacing the removable decorative insert with a substitute removable decorative insert by removing the removable decorative insert from the body member by overcoming the resilient retaining force without having to initiate detachment of the body member from the bathroom wall structure, and subsequently installing the substitute removable decorative insert within the body member.

19. The method according to claim 14 including installing a first end cap on a first end of the body member and a second end cap on a second end of the body member, forming a recess to extend along the front facing side of the body member from the first end to the second end, forming a recess in each of the first and second end caps that is aligned with the recess in the body member, and installing the removable decorative insert in the recesses formed within the body member and first and second ends caps such that the outermost surface of the removable decorative insert extends uninterrupted from one end of the removable insert at the first end cap to an opposite end of the removable insert at the second end cap.

20. The method according to claim 17 wherein the removable decorative insert has a rearwardly facing surface that faces the body member, an outwardly facing surface that faces opposite of the rearwardly facing surface, and longitudinal side edges interconnecting the outwardly and rearwardly facing surfaces along a length of the removable decorative insert, and including the step of installing at least one resilient member in the body member to resiliently grip the removable decorative insert substantially along at least one of the longitudinal side edges, and wherein the resilient member comprises a resilient tube that is movable between an initial shape when the removable decorative insert is removed from the recess and a compressed shape when the removable decorative insert is installed within the recess.

21. A method of assembling a bathroom grab bar comprising the steps of:

(a) providing a body member having a front facing side and a wall facing side opposite of the front facing side;

(b) installing a removable decorative insert in the front facing side of the body member such that a front face of the removable decorative insert forms a decorative outer surface of the bathroom grab bar; and (c) solely retaining the removable decorative insert within the body member via a resilient retaining member.

22. The bathroom grab bar according to claim 1 wherein said removable decorative insert is resiliently retained within said body member via a resilient retaining force such that said removable decorative insert is configured to be removable from said body member by overcoming the resilient retaining force and without having to initiate detachment of said body member from the bathroom wall structure.

23. The bathroom grab bar according to claim 1 including a first end cap installed on a first end of said body member and a second end cap installed on a second end of said body member, a recess formed to extend along said front facing side of said body member from said first end to said second end, a recess formed in each of said first and second end caps that is aligned with said recess in said body member, and wherein said removable decorative insert is positioned in said recesses formed within said body member and within said first and second ends caps such that said decorative outer surface of said removable decorative insert presents an outermost surface that extends uninterrupted from one end of said removable decorative insert to an opposite end of said removable decorative insert.

24. The bathroom grab bar according to claim 1 wherein said removable decorative insert has a rearwardly facing surface that faces said body member, an outwardly facing surface that faces opposite of said rearwardly facing surface, and longitudinal side edges interconnecting said outwardly and rearwardly facing surfaces along a length of said removable decorative insert, and including at least one resilient member installed within said body member to resiliently grip said removable decorative insert substantially along at least one of said longitudinal side edges.

25. The bathroom grab bar according to claim 1 wherein said removable decorative insert is solely retained to said body member with a resilient retaining member.

26. The bathroom grab bar according to claim 1 wherein said decorative outer surface comprises a direct gripping surface for a user.

27. The bathroom grab bar according to claim 1 including a first end cap installed on a first end of said body member and a second end cap installed on a second end of said body member, and including a first base flange and post assembly configured to attach said first end of said body member to the bathroom wall structure and a second base flange and post assembly configured to attach said second end of said body member to the bathroom wall structure such that said body member can be gripped by a user, and wherein said first and second end caps include an extension that cooperates with a post portion of a respective one of said first and second base flange and post assemblies to secure said first and second ends caps to said body member.

28. The method according to claim 14 including forming the decorative outer surface as a direct gripping surface for a user.

29. The method according to claim 14 including

Installing a first end cap on a first end of the body member and a second end cap installed on a second end of the body member, attaching a first base flange and post assembly to the first end of the body member and attaching a second base flange and post assembly to the second end of the body member, and providing the first and second end caps with an extension that cooperates with a post portion of a respective one of the first and second base flange and post assemblies to secure the first and second ends caps to the body member.

* * * * *